US006711922B1

(12) United States Patent
Tsai

(10) Patent No.: US 6,711,922 B1
(45) Date of Patent: Mar. 30, 2004

(54) MECHANISM OF A COMBINATION LOCK FOR BEGINNING AND ENDING COMBINATION-CHANGING OPERATION

(75) Inventor: Cheng-Tao Tsai, Tainan (TW)

(73) Assignee: Jaeyou Co., Ltd., Tainan (TW)

( * ) Notice: Subject to any disclaimer, the term of this patent is extended or adjusted under 35 U.S.C. 154(b) by 0 days.

(21) Appl. No.: 10/347,885

(22) Filed: Jan. 22, 2003

(51) Int. Cl.[7] ..... E05B 37/02
(52) U.S. Cl. ..... 70/312; 70/30; 70/315
(58) Field of Search ..... 70/311, 312–319, 70/30, 22, 27, 28, 324

(56) References Cited

U.S. PATENT DOCUMENTS

| | | | | | |
|---|---|---|---|---|---|
| 4,341,101 | A | * | 7/1982 | Bako | 70/312 |
| 4,343,163 | A | * | 8/1982 | Scelba et al. | 70/312 |
| 4,343,164 | A | * | 8/1982 | Bako | 70/312 |
| 4,343,165 | A | * | 8/1982 | Bako | 70/312 |
| 4,389,863 | A | * | 6/1983 | Bako | 70/312 |
| 4,719,776 | A | * | 1/1988 | Molnar | 70/312 |
| 4,766,748 | A | * | 8/1988 | Yang | 70/312 |
| 5,027,623 | A | * | 7/1991 | Ling | 70/26 |
| 5,924,313 | A | * | 7/1999 | Kuo | 70/26 |
| 5,934,120 | A | * | 8/1999 | Kuo | 70/312 |
| 5,953,940 | A | * | 9/1999 | Ling | 70/25 |
| 6,058,744 | A | * | 5/2000 | Ling | 70/28 |
| 6,209,368 | B1 | * | 4/2001 | Lee | 70/312 |
| 6,386,005 | B1 | * | 5/2002 | Kuo | 70/28 |
| 6,422,051 | B1 | * | 7/2002 | Kuo | 70/312 |
| 6,508,089 | B1 | * | 1/2003 | Tsai | 70/213 |
| 2002/0104337 | A1 | * | 8/2002 | Kuo | 70/30 |

* cited by examiner

*Primary Examiner*—Suzanne Dino Barrett
(74) *Attorney, Agent, or Firm*—Rosenberg, Klein & Lee

(57) ABSTRACT

A mechanism of a combination lock for beginning and ending combination-changing operation includes a pressing block, which is fitted to a front end of the spindle of the combination lock and associated with a pad. The pad has posts contacting a most front one of several spring-loaded tooth dishes, which separably engage respective dials. The pressing block is pressed towards a rear end of the spindle to force the tooth dishes to disengage respective dials so that the dials can be turned relative to the tooth dishes for changing the unlocking numeral combination to a new one. When the combination changing operation is finished, the pressing block is pushed back to the original position for the tooth dishes to engage respective dials; thus, after the combination changing operation, movement of the pressing block back to the original position can't cause rotation of the dials accidentally.

2 Claims, 6 Drawing Sheets

MECHANISM OF A COMBINATION LOCK FOR BEGINNING AND ENDING COMBINATION-CHANGING OPERATION

BACKGROUND OF THE INVENTION

1. Field of the invention

The present invention relates to a mechanism for beginning and ending the unlocking numeral-combination changing operation of a combination lock, more particularly one, which, while being moved from the position allowing the combination-changing action back to the normal position, cannot cause unwanted rotational movement of the dials, thus preventing accidental change of the combination after it has been changed to a predetermined one.

2. Brief Description of the Prior Art

Referring to FIG. 12, a conventional changeable combination lock includes:

a lock bar 81, which has a cone-shaped head, a lock rod 813 joined to the head; the cone-shaped head having a trench 812; the lock rod 813 having spaced apart teeth 8131, and spaces 8132 between the teeth 8131;

a spindle 84, which has a convex edge 841 at a front end, a channel 842 having an upper opening, and flat sides on a bottom and an upper side of a rear end thereof, on which a fixing hole 843 is formed;

a thimble 85, which has a round disk, and an annular wall around the disk; the disk having a through hole 853, two protruding blocks 851, 851 at opposite portions of the inward side thereof, and a stopping block 852 on the outward side thereof;

several dials 87, each of which has numerals 8705 spaced out on an outer side, an inserting hole 8701 on the middle, spaced teeth 8702 projecting towards the center thereof, spaced convexly curved surfaces 8704, and withholding spaces 8703 between the teeth 8702;

several tooth dishes 871, each of which has an inserting hole 8711, a gap 8712, and spaced apart convex teeth 8713 on an outward side thereof;

a spring 844 for biasing the tooth dishes 871 to an engaged position where the convex teeth 8713 engage the teeth 8704 of corresponding dials 87 so that the tooth dishes 871 will be turned together with corresponding dials 87;

a barrel 83, which has a cone-shape, a cavity 831, a hole 832, a pin hole 833 in communication with the hole 832, and a trench 834; the hole 832 having flat upper and lower sides;

a setting push ring 86, which has a gap 861, and protruding edges 862 at two opposite portions of an outward side thereof; each of the protruding edges 862 having a slope 8621; and, holding elements 88, each of which has a gap 8801, and two opposite engaging protrusions 8802; the holding elements 88 being used for holding respective sliding elements 881 in position, each of which has a gap 8811, two recesses at two opposite portions of an outward side thereof, the spindle 84 being passed through the thimble 85, the setting push ring 86, a first one of the dials 87, a first one of the tooth dishes 871, a first one of the holding elements 88, a first one of the sliding elements 881, a second one of the dials 87, a second one of the tooth dishes 871 and so on, and being finally passed through the spring 844 and inserted into the hole 832 of the barrel 83; the protruding blocks 851 of the thimble 85 being pressed against the slopes 8621 of the setting push ring 86; the teeth 8713 of the tooth dishes 871 being engaged with the teeth 8702 of respective dials 87; a pin 835 being inserted into the pin hole 833, and the fixing hole 843 to securely join the spindle 84 to the barrel 83.

Thus, the lock bar 81 is locked with the tooth dishes 871, and incapable of separating from the spindle 84 when the dials 87 are turned off the unlocking numeral combination.

To change the unlocking numeral combination, first the thimble 85 is turned so that the protruding blocks 851 of the thimble 85 slide on the slopes 8621 of the setting push ring 86 to push the setting push ring 86, and in turn, the tooth dishes 871 are disengaged from the respective dials 87. Then, the dials 87 are turned so that orientation of the dials 87 relative to the gaps 8712 of respective tooth dishes 871 is changed. Finally, the thimble 85 is turned back to the original position for allowing the spring 844 to force the tooth dishes 871 to engage the respective dials 87 again.

Referring to FIG. 3, another conventional changeable combination lock is substantially like the above one except having folded elastic wires 985, and holding elements 98 instead of the sliding elements 881 and the holding elements 88; the folded elastic wires 985 are held in position by means of the holding elements 98.

Both the conventional changeable combination locks are found to have a disadvantage that when the thimble 85 is being moved back to the normal position after the numeral combination-changing action, undesired rotational movement of the dials are prone to be caused accidentally. In other words, accidental change of the combination is likely to happen after the combination has been changed to a predetermined one, causing the user a lot of inconvenience.

SUMMARY OF THE INVENTION

It is a main object of the present invention to provide a mechanism for beginning and ending the unlocking-numeral combination-changing operation, which is structured such that movement thereof cannot cause rotational movement of the dials accidentally.

The present mechanism includes a pressing block fitted to the front end of a spindle of a changeable combination lock and associated with a pad. The pad has posts contacting a most front one of several spring-loaded tooth dishes, which separably engage respective dials each having numerals spaced on the outer side.

The pressing block is pressed towards a rear end of the spindle so that the posts force all the tooth dishes to move rearwards to disengage respective dials; thus, the dials can be turned relative to the tooth dishes for changing the unlocking numeral combination to a new one; the pressing block is pressed slightly down right after being pushed rearwards so that it can be held in position allowing the tooth dishes to stay disengaged from respective dials. When the combination changing operation is finished, the pressing block is pushed back to the original position for the tooth dishes to engage respective dials again.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
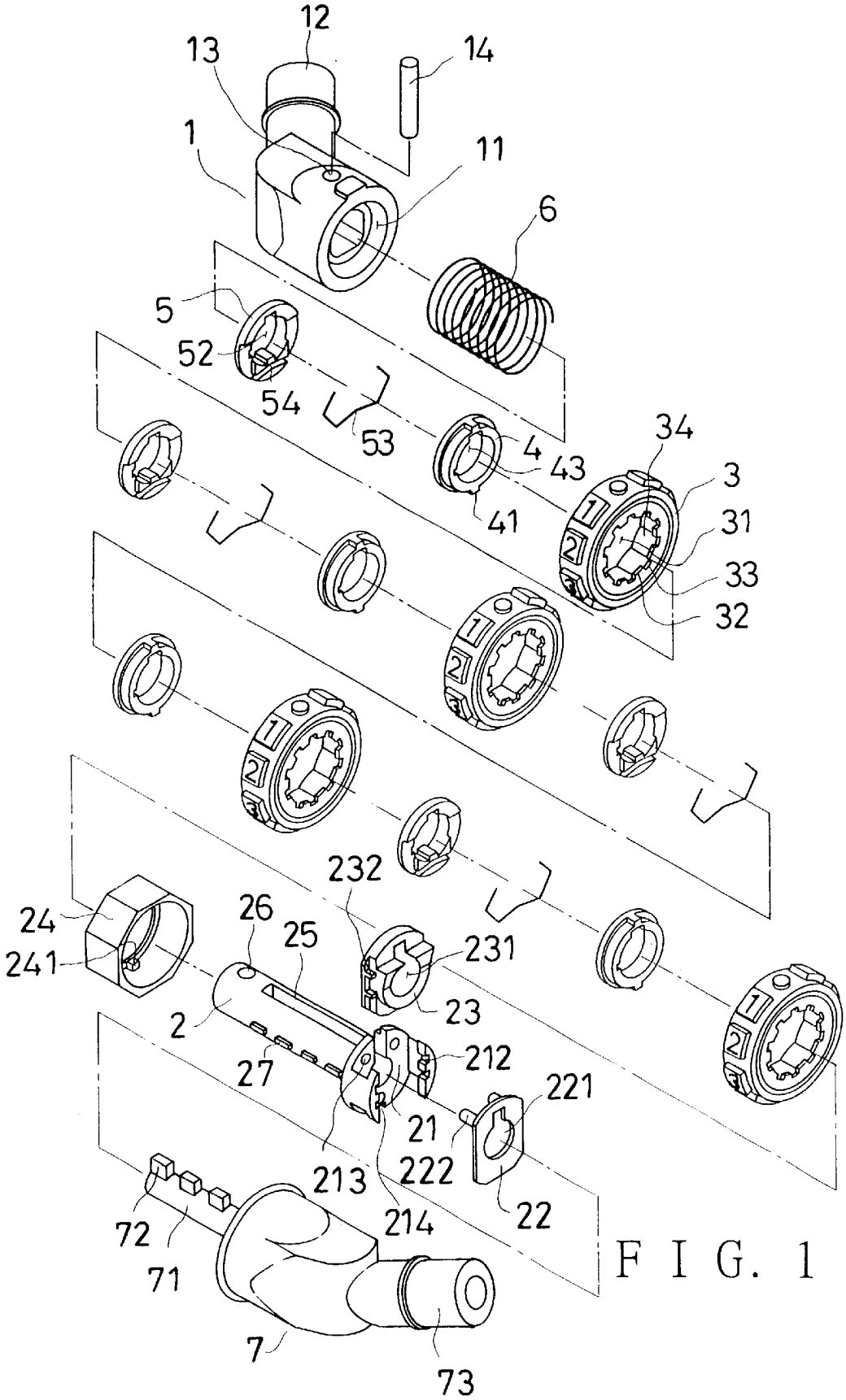
FIG. 1 is an exploded perspective view of a combination lock according to the present invention.
Figure 2:
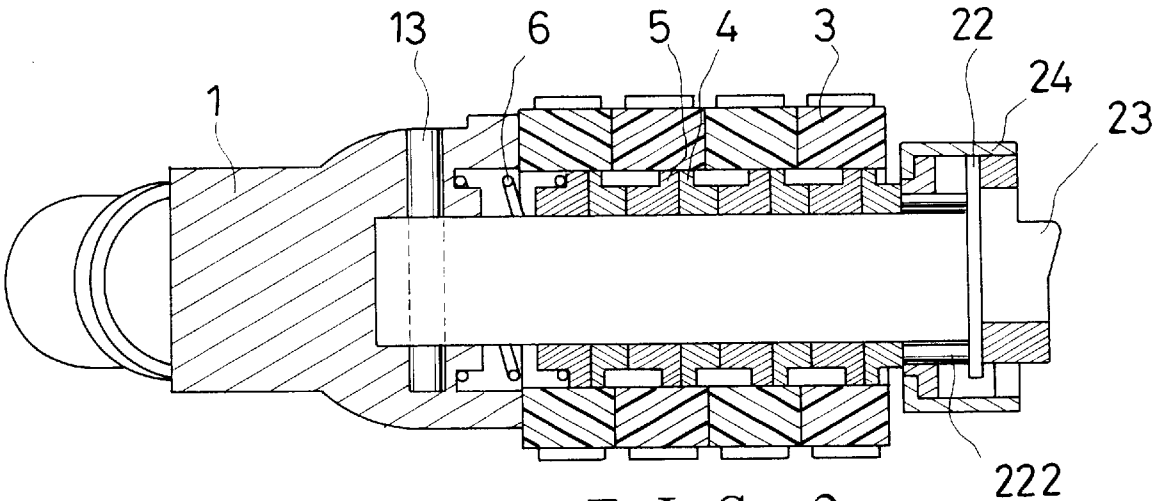
FIG. 2 is a cross-sectional view of the combination lock according to the present invention.
Figure 7:
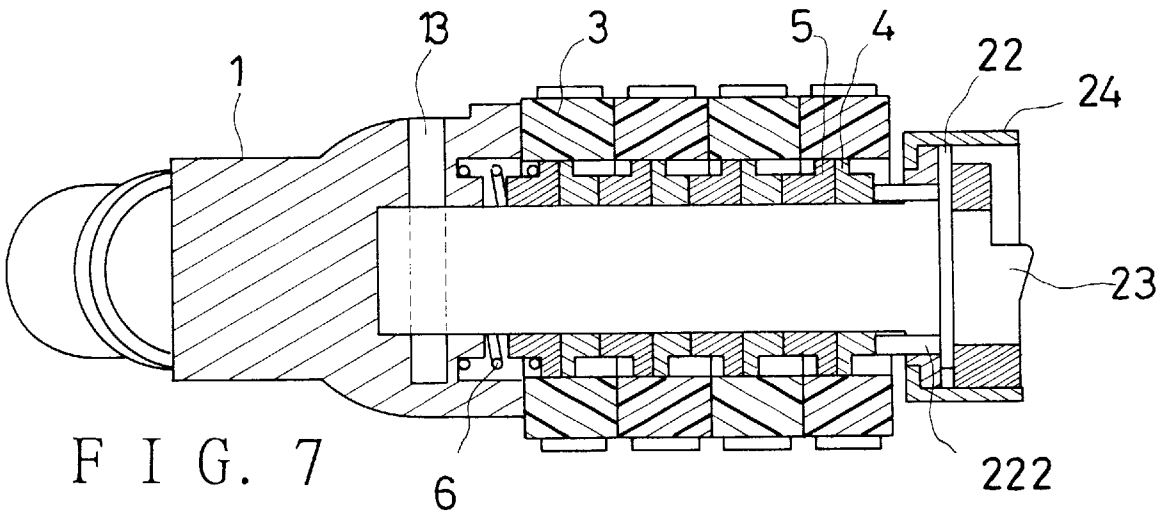
FIG. 7 is another cross-sectional view of the combination lock according to the present invention.
Figure 3:
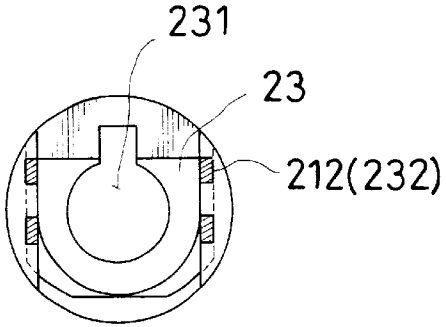
FIG. 3 is a front view of the combination changing mechanism of a combination lock according to the present invention.

Referring to FIG. 1, the combination lock of the present invention includes a lock bar 7, several dials 3, several tooth dishes 4, a spring 6, and a lock barrel 1, which have either the same shape or the same function as the lock bar 81, the dials 87, the tooth dishes 871, the spring 844, the barrel 83 of the first conventional combination lock described in the Background respectively; the lock bar 7 has a connecting portion 73 for a steel wire (not shown) to be connected to, a lock rod 71, and several teeth 72 spaced along the lock rod 71; each of the dials 3 has numerals spaced out on an outer side, an inserting hole 31 on the middle, spaced teeth 32 projecting towards the center thereof, spaced convexly curved surfaces 34, and withholding spaces 33 between the teeth 32; each of the tooth dishes 4 has a through hole 43, and a tooth 41 projecting out from the edge; the barrel 1 has a connecting cavity 11, a connecting portion 12 for the other end of the steel wire to be connected to, and a pin hole 13.

The present combination lock also has several combinations of folded elastic wire 53 and holding element 5, which are the same as the combinations of folded elastic wire 985 and holding element 98 of the second conventional combination lock of the Background; each of the holding elements 5 has a through hole 52, and a holding trench 54, on which a respective folded elastic wire 53 is held in position.

The combination lock is further equipped with a mechanism for beginning and ending a combination-changing operation according to the present invention, which includes:

spindle 2, which includes a holding room 21 at a front end portion, a holding slot 25, several locating gaps 212 in front of the holding room 21, through holes 213 behind the holding room 21, a cavity 214 at a bottom of the front end, a fixing hole 26 at a rear end, and spaced protrusions 27;

a pad 22, which has a through hole 221, and posts 222 sticking out from a rear side to be passed through the through holes 213 of the spindle 2;

a pressing block 23, which has a through hole 231, and locating protrusions 232 on a front side thereof to be separably engaged with the locating gaps 212; and, a thimble 24, which has a protrusion 241 on an inner edge.

To assemble the present lock, the spindle 2 is passed through a first one of the dials 3, a first one of the tooth dishes 4, a first one of the holding elements 5, a second one of the dials 3, a second one of the tooth dishes 4 and so on, and is finally passed through the spring 6 and inserted into the hole 11 of the barrel 1; the spring 6 biasing the tooth dishes 4 towards the front end of the spindle 2 so that the teeth 41 of the tooth dishes 4 are engaged with the teeth 32 of respective dials 3; a pin 14 being inserted into both the pin hole 13 of the barrel 1 and the fixing hole 26 of the spindle 2 to securely join the spindle 2 to the barrel 1. Then, the posts 222 of the pad 22 are passed through respective through holes 213 of the spindle 2 to come into contact with a most front one of the tooth dishes 4, and the pressing block 23 is positioned in the holding room 21 of the spindle 2 and over the pad 22. Finally, the thimble 24 is fitted around the front end portion of the spindle 2 with the protrusion 241 being engaged with the cavity 214 of the spindle 2 so that the pressing block 23 is confined in the holding room 21 and the thimble 24 can't be turned relative to the spindle 2.

Referring to FIGS. 2 to 6, when the pressing block 23 is not pressed inwardly of the spindle 2, the spring 6 forces the tooth dishes 4 to engage the withholding holes 33 of corresponding dials 3 at the convex teeth 41 of the tooth dishes 4 so that the tooth dishes 4 will turn together with corresponding dials 3.

Figure 8:
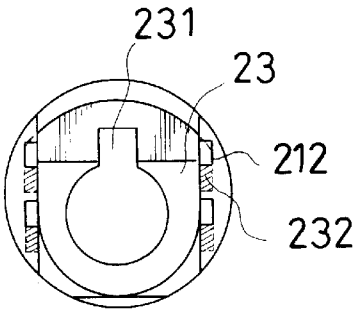
FIG. 8 is another front view of the combination changing mechanism according to the present invention.
Figure 4:
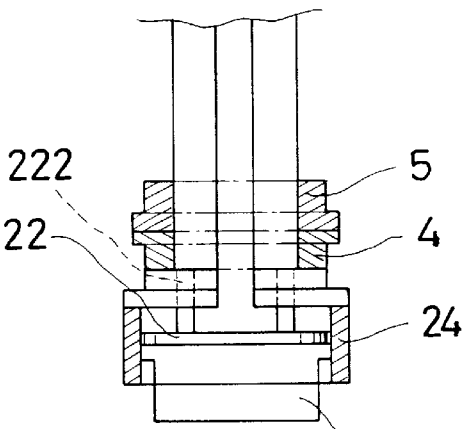
FIG. 4 is a partial vertical view of the combination changing mechanism of a combination lock according to the present invention.
Figure 9:
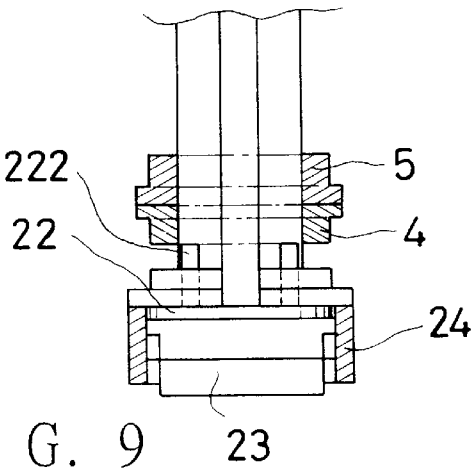
FIG. 9 is another partial vertical view of the combination changing mechanism according to the present invention.
Figure 6:
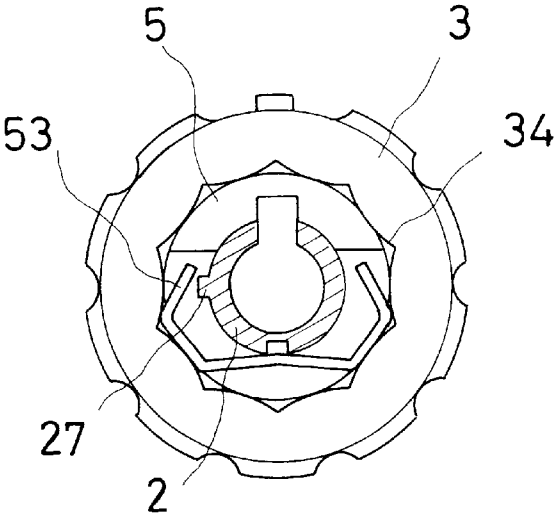
FIG. 6 is another front view of an inner part of the combination lock according to the present invention.
Figure 11:
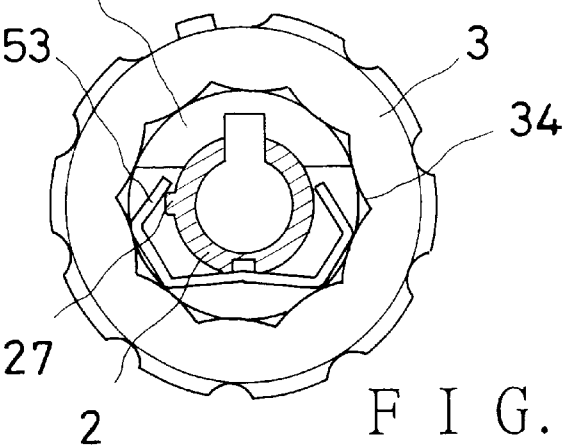
FIG. 11 is yet another front view of an inner part of the combination lock according to the present invention.
Figure 5:
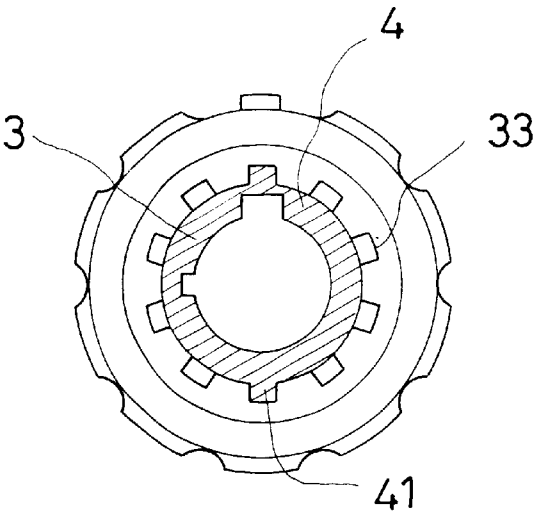
FIG. 5 is a front view of an inner part of the combination lock according to the present invention.
Figure 10:
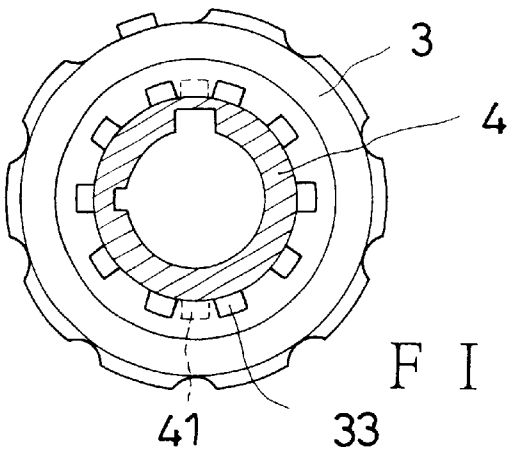
FIG. 10 is another front view of an inner part of the combination lock according to the present invention.
Figure 12:
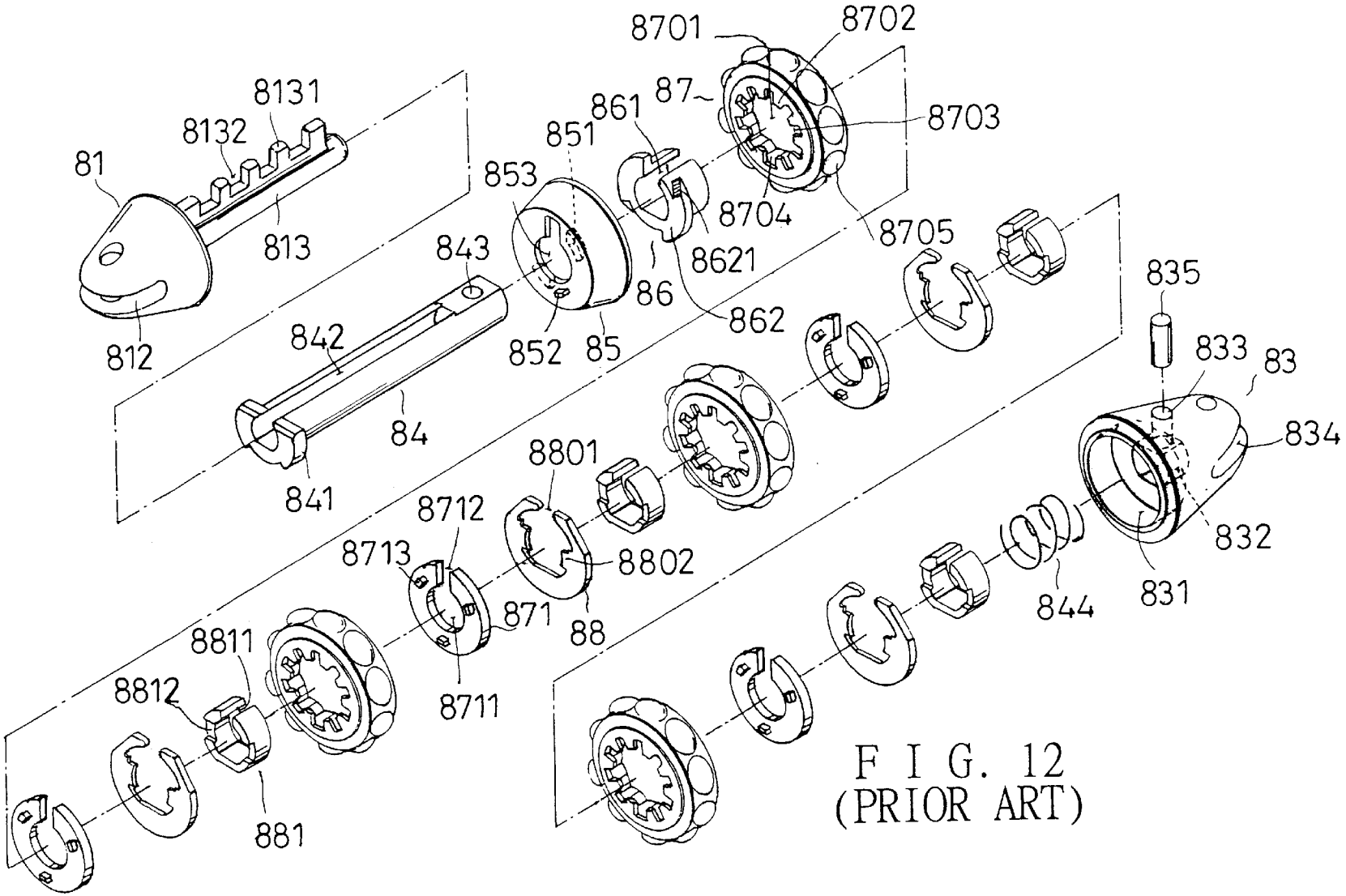
FIG. 12 (PRIOR ART)
FIG. 12 is an exploded perspective view of the first combination lock as described in the Background; and, FIG. 13 is an exploded perspective view of the second combination lock as described in the Background.
Figure 13:
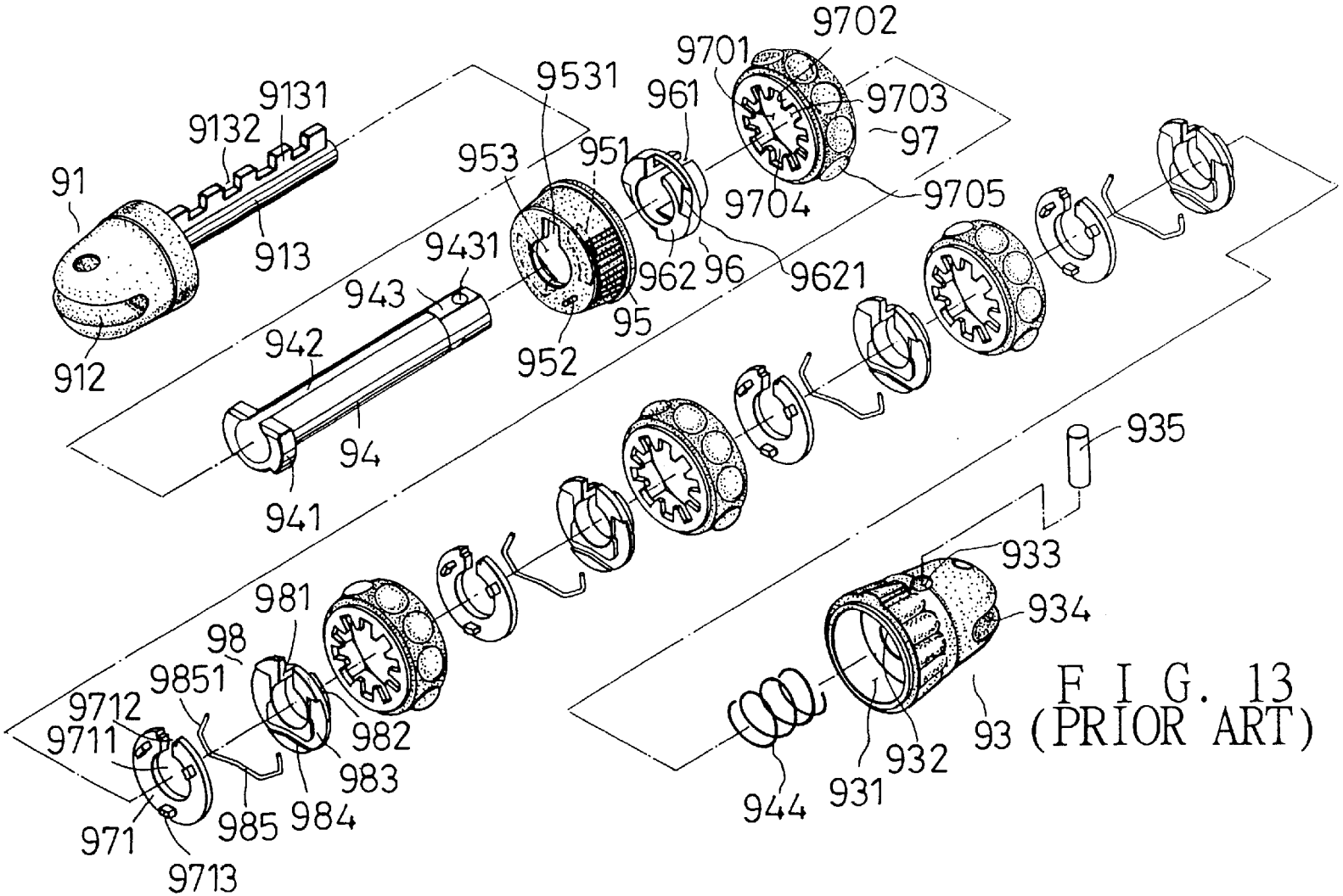
FIG. 13 (PRIOR ART)

The pressing block 23 has to be first pressed inwardly of the spindle 2 for beginning the combination changing operation. Referring to FIGS. 7 to 11, when the pressing block 23 is pressed inwardly of the spindle 2, the locating projections 232 of the pressing blocks 23 will be separated from the locating gaps 212 of the spindle 2, and the posts 222 of the pad 22 will act against the spring 6 to cause the tooth dishes 4 to move towards the rear end of the spindle 2 so that the convex teeth 41 separate the withholding holes 33 of corresponding dials 3. At the same time, the pressing block 23 is made to slide down for a short distance, and then released so that the locating projections 232 are pressed against the those portions of the front end of the spindle 2 that are adjacent to the locating gaps 212, as shown in FIG. 8; thus, the tooth dishes 4 will stay disengaged from respective dials 3, and the users doesn't have to keep pressing the block 23 while they are turning the dials 3 relative to the tooth dishes 4 to change the combination of unlocking numerals.

After the combination of unlocking numerals has been changed to a new one, the pressing block 23 is pushed up so that the locating projections 232 are made to snap back into the locating gaps 212 with the spring 6, which also makes the tooth dishes 4 engage respective dials 3 at the same time so that the tooth dishes 4 can be turned together with respective dials 3, i.e. the combination lock can be used normally. To use the combination lock, the toothed lock rod 71 of the lock bar 7 is inserted into the holding slot 25, and the dials 3 are turned so that other people can't find the unlocking numeral combination.

From the above description, it can be easily understood that the present mechanism for beginning and ending a combination-changing operation is relatively convenient to use as compared with the above conventional ones because only one hand is required for beginning the combination changing operation instead of two. And, the operation of the present mechanism won't cause accidental rotation of the dials, thus preventing accidental change of the unlocking numeral combination after it has been changed to a new one.

What is claimed is:

1. A mechanism of a combination lock for beginning and ending combination-changing operation, comprising a spindle including a holding room at a front end portion, a holding slot for allowing insertion of a toothed lock bar therein, a plurality of through holes behind the holding room, and a plurality of locating gaps in front of the holding room; the combination changing mechanism being provided for effecting disengagement of tooth dishes from respective dials of a combination lock, which have spaced numerals on an outer side; the tooth dishes being fitted around the spindle to disengageably engage the toothed lock bar, and being biased towards the front end of the spindle to engage respective dials with a spring so that the tooth dishes will turn together with respective dials;

a pad movably positioned in the holding room; the pad including a through hole for allowing the toothed lock bar to be passed through, and posts sticking out from a rear side thereof and passed through respective through holes of the spindle to come into contact with a most front one of the tooth dishes;

a pressing block movably positioned in the holding room; the pressing block including a through hole for allowing the toothed lock bar to be passed through, and locating protrusions on a front side thereof to be separably engaged with the locating gaps of the spindle; and, a thimble fitted around the front end of the spindle for confining the pressing block therein; the thimble having a protrusion on an inner edge engaged with a cavity on the spindle;

the pressing block being pressed towards a rear end of the spindle for the posts of the pad to move the tooth dishes towards a rear end of the spindle so that the tooth dishes are disengaged from respective dials, allowing the dials to be turned relative to respective tooth dishes for an unlocking numeral combination to be changed.

2. The mechanism of a combination lock for beginning and ending combination-changing operation as claimed in claim 1, wherein after the pressing block can be pressed towards a rear end of the spindle for beginning a combination changing operation, the pressing block is moved down relative to the locating gaps for the locating projections thereof to be pressed against portions of the front end of the spindle that are adjacent to the locating gaps so that the tooth dishes will stay disengaged from respective dials.

* * * * *